US005547418A

United States Patent [19]

Takahashi

[11] Patent Number: 5,547,418

[45] Date of Patent: Aug. 20, 1996

[54] OPTICAL FIBER END-SURFACE POLISHING DEVICE

[75] Inventor: Mitsuo Takahashi, Matsudo, Japan

[73] Assignee: Seikoh Giken Co., Ltd., Chiba-ken, Japan

[21] Appl. No.: 397,967

[22] Filed: Mar. 3, 1995

[30] Foreign Application Priority Data

Oct. 7, 1994 [JP] Japan ..... 6-270530

[51] Int. Cl.[6] ..... B24B 7/00

[52] U.S. Cl. ..... 451/278; 451/41; 451/390; 451/283

[58] Field of Search ..... 451/49, 57, 59, 451/41, 283, 285, 287, 288, 397, 398, 270, 271, 278, 282, 365, 390

[56] References Cited

U.S. PATENT DOCUMENTS 4,831,784 5/1989 Takahashi ..... 451/270
4,979,334 12/1990 Takahashi .
5,216,846 6/1993 Takahashi ..... 51/326
5,265,381 11/1993 Takahashi ..... 451/41
5,351,445 10/1994 Takahashi .

FOREIGN PATENT DOCUMENTS 1009724 4/1983 U.S.S.R. ..... 451/41

*Primary Examiner*—Bruce M. Kisliuk
*Assistant Examiner*—Eileen P. Morgan
*Attorney, Agent, or Firm*—Spencer & Frank

[57] ABSTRACT

An optical fiber end-surface polishing device has an improved ferrule fixing device allowing ferrules with optical fibers to be attached to or detached from a holder plate for polishing by a simple operation. The optical fiber end-surface polishing device, having a ferrule fixing device, simultaneously polishes the end surfaces of a plurality of ferrules with optical fibers fixed to and supported by a holder plate. The device includes ferrule accommodating sockets provided on the holder plate and having through holes for accommodating ferrules; and ferrule presser levers supported by stationary shafts substantially parallel to the through holes and biased toward descent by biasing devices, wherein each of the ferrule presser levers is movable between an angular position where the ferrules inserted into the associated ferrule accommodating sockets are downwardly pressed and an angular position where the polished ferrules can be detached.

2 Claims, 2 Drawing Sheets

OPTICAL FIBER END-SURFACE POLISHING DEVICE

BACKGROUND OF THE INVENTION

1. Field of the Invention

The present invention relates to an optical fiber end-surface polishing device having a ferrule fixing device, which is applicable to an optical fiber end-surface polishing device for simultaneously polishing a plurality of optical fibers.

More specifically, the present invention relates to an optical fiber end-surface polishing device having an improved ferrule fixing means that allows ferrules with optical fibers to be attached to and detached from a holder plate for polishing by a simple operation.

2. Description of the Related Art

The present inventor has made several inventions regarding an optical fiber end-surface polishing device for simultaneously polishing a plurality of optical fibers.

Among them are the following four inventions, all of which relate to a polishing device capable of simultaneously polishing the end surfaces of a plurality of optical fibers:

U.S. Pat. No. 4,831,784 "POLISHING APPARATUS FOR END SURFACES OF OPTICAL FIBERS"

U.S. Pat. No. 4,979,334 "OPTICAL FIBER END SURFACE POLISHING DEVICE"

U.S. Pat. No. 5,216,846 "METHOD AND APPARATUS FOR GRINDING FOREMOST END OF A FERRULE"

Japanese Patent Laid-Open No. 6-179161 (U.S. Ser. No. 08/019,303) "APPARATUS FOR GRINDING END FACES 0F FERRULES TOGETHER WITH OPTICAL FIBERS EACH FIRMLY RECEIVED IN FERRULES"

These inventions relate to a polishing device in which the end surface of an optical fiber to be polished is pressed against a polishing disc while effecting a relative movement composed of turning and revolution, thereby polishing the end surface of the optical fiber.

FIG. 3 is a plan view of a polishing holder or holder plate in a conventional optical fiber end-surface polishing device for simultaneously polishing the end surfaces of a plurality of optical fibers; and FIG. 4 is a sectional view showing a ferrule fixed to the holder plate of the conventional polishing device shown in FIG. 3.

A holder plate 1 for polishing is formed as a disc and has at its center a cylindrical hub section 2 into which a holding shaft (not shown) is inserted.

Arranged along the circumference of a concentric circle, indicated by the dashed line E, are a plurality of mounting members 3 of the same structure for mounting devices with optical fibers. The sectional view of FIG. 4, taken along the line4—4 of FIG. 3, shows an example of the polishing holder for polishing. FIG. 4 shows an end surface 6 of an FC-type ferrule 5 to which an optical fiber 4 is attached.

Each mounting member 3 has an accommodating socket 7 for fixing the ferrule, and a cap nut 9. The socket 7 for fixing the ferrule has at its center a through hole for accommodating the FC-type ferrule 5 and is forced into a hole provided in the holder plate 1 and secured therein. Further, a male screw 8 is provided in the outer periphery of the socket 7 for fixing the ferrule. The cap nut 9 has a slit 10 and a female screw 8*a* to be engaged with the male screw 8 to fix the FC-type ferrule 5.

The operator tightens the cap nut 9 to fix the optical fiber ferrule 5 to the holder plate 1, and presses the end surface 6 of the ferrule 5 against the polishing disc 11 to perform polishing by a relative movement such that the tip end of the ferrule 5 with an optical fiber describes an arcuate trajectory.

In many conventional optical fiber end-surface polishing devices, the mounting of the ferrule 5 with an optical fiber is effected by inserting the ferrule 5 into the through hole of the ferrule accommodating socket 7 and then engaging the slitted cap nut 9 with the male screw 8 provided on the outer peripheral surface of the socket, as described above.

This structure has a problem in that the slitted cap nut 9 is liable to be lost during operation and that it takes 10 to 20 seconds per unit to effect fixation by tightening the nuts. Further, whereas the principal dimensions of the currently-used optical connector ferrules are: an outer diameter of 2.5 mm and an effective length of 8 mm, an optical connector ferrule whose dimensions are approximately reduced in half is being developed and will be put into practical use to reduce the size of optical circuit systems. In this regard, the conventional structure based on screwing as described above is expected to become too minute, making the mounting operation rather difficult.

SUMMARY OF THE INVENTION

It is an object of the present invention to provide an optical fiber end-surface polishing device having an improved ferrule fixing means which allows ferrules with optical fibers to be attached to and detached from a holder plate for polishing by an easy operation.

To achieve the above object, there is provided, in accordance with the present invention, an optical fiber end-surface polishing device having a ferrule fixing means of the type in which a plurality of ferrules with optical fibers are fixed to and supported by a holder plate so as to enable their end surfaces to be polished simultaneously, the optical fiber-end surface polishing device comprising:

ferrule accommodating sockets provided in the holder plate and having through holes for receiving ferrules, the ferrule accommodating sockets imposing a limit to the descent of the ferrules;

ferrule presser levers supported so as to be rotatable on stationary shafts substantially parallel to the through holes and biased downwardly by a biasing means, wherein each ferrule presser lever is movable between an angular position where the ferrules inserted into the associated ferrule accommodating sockets are pressed downwardly and an angular position where the polished ferrules can be detached.

Each ferrule presser lever has a plurality of lever sections capable of reaching the peripheral edges of a plurality of ferrule accommodating sockets.

The biasing means may consist of a spring adapted to bias each ferrule presser lever toward descent along the stationary shaft.

A compression spring may be provided between each ferrule presser lever and the associated stationary shaft, wherein the ferrule presser lever can be raised against the downward bias by means of an operating knob formed integrally therewith.

DESCRIPTION OF THE PREFERRED EMBODIMENT

The present invention will now be described in more detail with reference to the drawings.

Figure 1:
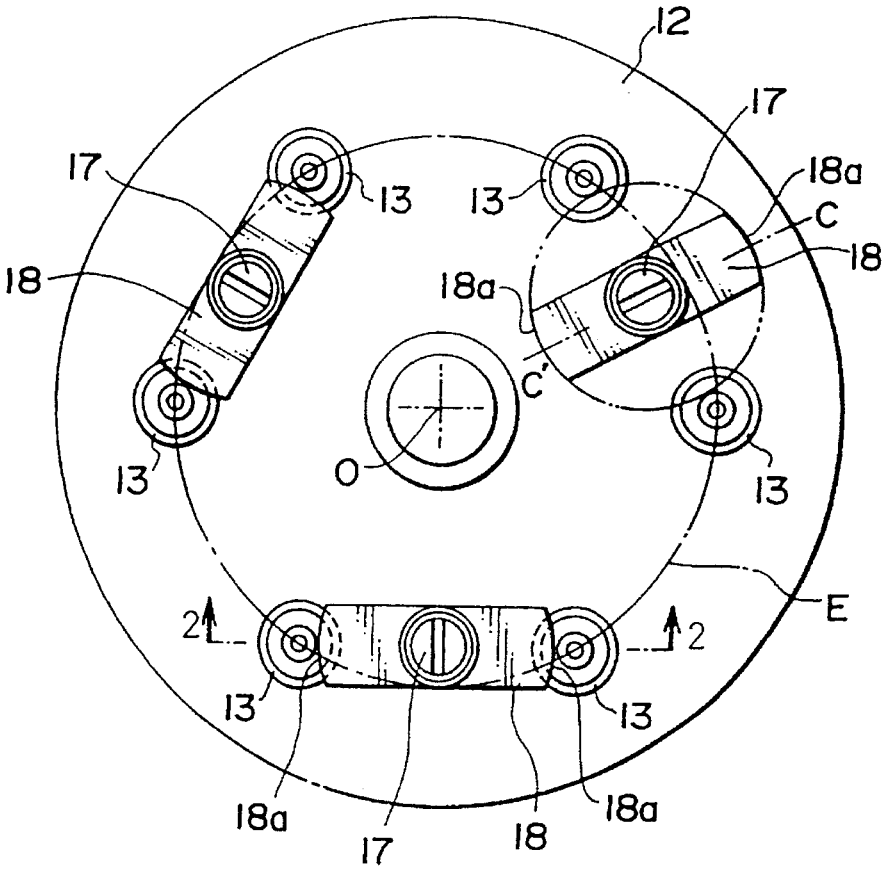
FIG. 1 is a plan view showing a holder plate in an optical fiber end-surface polishing device according to an embodiment of the present invention which has a ferrule fixing means on the holder plate.
Figure 2:
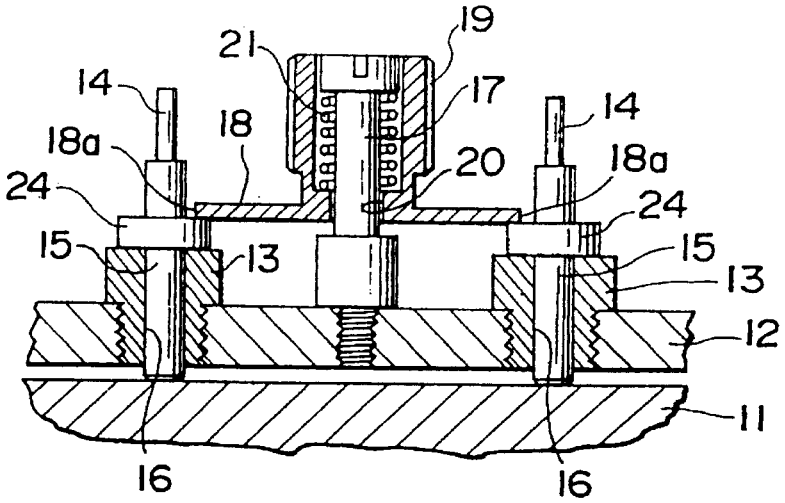
FIG. 2 is a sectional view of the ferrule fixing means of the embodiment shown in FIG. 1.
Figure 3:
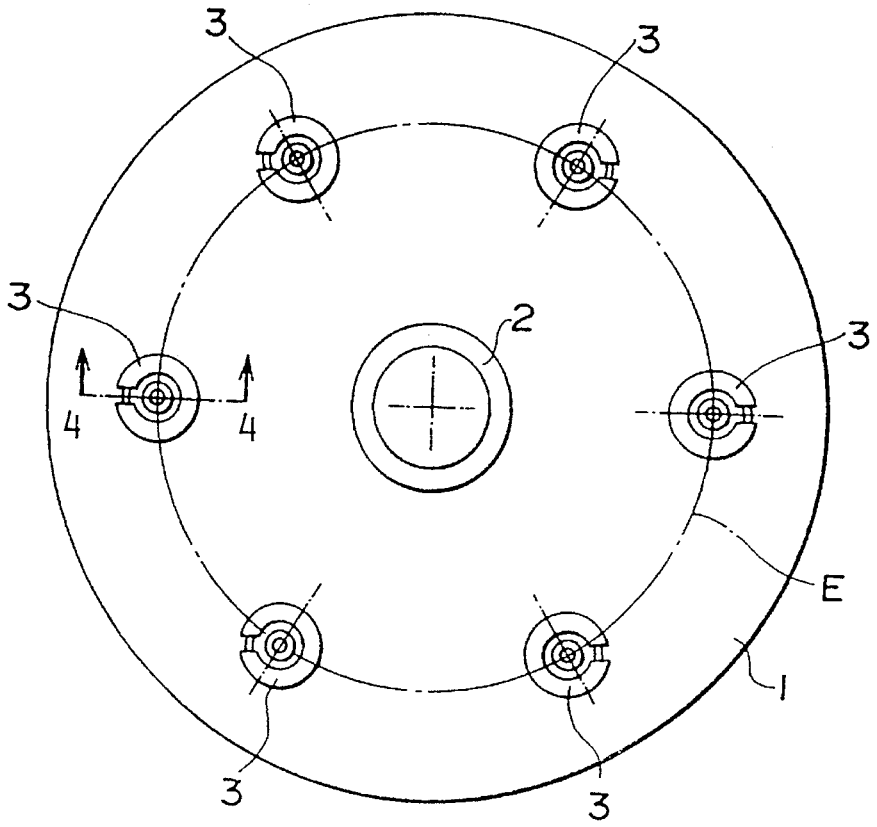
FIG. 3 PRIOR ART
FIG. 3 is a plan view of a holder plate in a conventional optical fiber end-surface polishing device.
Figure 4:
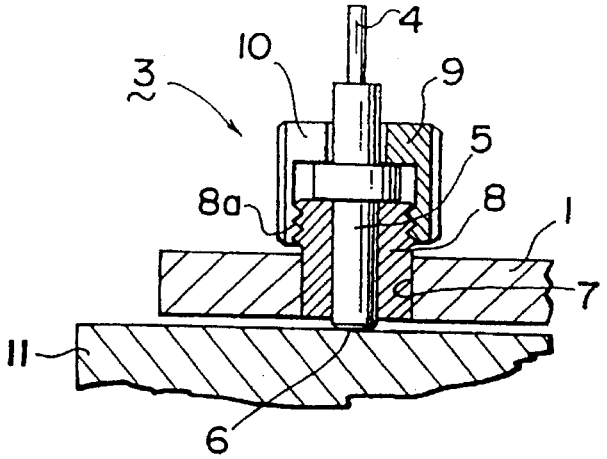
FIG. 4 PRIOR ART
FIG. 4 is a sectional view showing a ferrule fixed to the holder plate of the conventional polishing device shown in FIG. 3.

FIG. 1 is a plan view of a holder plate in an optical fiber end-surface polishing device according to an embodiment of the present invention, and FIG. 2 is a sectional view of the ferrule fixing means of the embodiment.

A holder plate 12 for polishing is formed as a thin and flat disc. A plurality of ferrule accommodating sockets 13, each having a through hole 16 into which a ferrule 15 with an optical fiber 14 attached thereto is inserted, are arranged along the circumference of a circle E on the flat surface of the holder plate 12 and fastened thereto by means of screws. Stationary shafts 17, each having a screw at its lower end, are vertically mounted on the holder plate 12 so as to be adjacent to the ferrule accommodating sockets 13.

A ferrule presser lever 18 is provided on each stationary shaft 17 so as to be rotatable around it.

Each ferrule presser lever 18 is provided with a cylindrical operating knob 19 integrally formed in the central portion thereof. Each operating knob 19 has a hole into which the stationary shaft 17 is inserted and which can accommodate a compression coil spring 21.

Next, the procedures for fixing the ferrule 15 with an optical fiber to the holder plate will be described.

First, the outer edge portions (or tip ends) 18*a* of each ferrule presser lever 18 are at least positioned such that they do not cover the through holes 16 of the associated ferrule accommodating sockets 13, as indicated, for example, at section C-C' of FIG. 1, and ferrules 15 with optical fibers attached are inserted into the through holes 16 of these ferrule accommodating sockets 13.

Next, the knob 19 is raised and turned so as to bring the ferrule presser lever 18 to a position indicated at 2—2, where the outer edge portions 18*a* of the presser lever 18 are in alignment with the upper surfaces of flanges 24 of the ferrules 15 with optical fibers attached. Then, the knob 19 is released.

The flanges 24 of the ferrules 15 with optical fibers attached are pressed by the lower surfaces of the outer edge portions 18*a* of the ferrule presser lever 18, which is messed downwardly by the compression coil spring 21. As a result, each pair of ferrules 15 with optical fibers attached can be independently and uniformly brought into pressure contact with the holder plate 12 for polishing and secured thereto.

After the polishing, the operating knob 19 is raised, and the outer edge portions 18*a* of the presser lever 18 are moved to the position indicated at C-C' in FIG. 1, thereby enabling the ferrules 15 with optical fibers to be removed from the holder plate.

The embodiment that has been described in detail above allows various modifications without departing from the scope of the present invention.

While in the above embodiment one ferrule presser lever presses two ferrules, it is also possible for one presser lever 18 to press one or three or more ferrules.

The optical fiber end-surface polishing device of the present invention having a ferrule fixing means uses a presser lever biased by a spring force or the like as the means for attaching and detaching a ferrule with an optical fiber to and from a holder plate for polishing.

The attaching and detaching operations are effected by turning the lever, so that the operations are very easy to perform. This makes the device Particularly suitable for the mounting and fixing of a ferrule with an optical fiber having minute dimensions.

What is claimed is:

1. An optical fiber end-surface polishing device for simultaneously polishing end surfaces of a plurality of optical fibers, comprising:

a holder plate for fixing and supporting a plurality of ferrules, each ferrule having an optical fiber attached thereto;

at least two ferrule accommodating sockets provided on the holder plate, each of said sockets having a through hole for accommodating a ferrule, each of said ferrule accommodating sockets including means for positioning the ferrule with respect to said holder plate;

a stationary shaft positioned on the holder plate and extending in a direction substantially parallel to that of the through holes;

a ferrule presser lever supported by and rotatable on said stationary shaft, said lever including an integrally formed operating knob in registration with the stationary shaft; and biasing means for urging the ferrule presser lever toward the holder plate, said biasing means comprising a compression spring provided between said ferrule presser lever and said stationary shaft, whereby the ferrule presser lever can be moved against a biasing force of the compression spring by moving the operating knob, and whereby said ferrule presser lever is movable between a first angular position where the ferrules inserted into the associated ferrule accommodating sockets are pressed against said holder plate by said ferrule presser lever and a second angular position where the polished ferrules are detachable from said holder plate.

2. An optical fiber end-surface polishing device according to claim 1, wherein said ferrule presser lever has a plurality of lever sections, each of said lever sections extending to a peripheral edge of one of said at least two ferrule accommodating sockets for fixing simultaneously the ferrules with optical fibers attached thereto accommodated by said at least two sockets.

* * * * *